US007330688B2

(12) United States Patent
Watanabe et al.

(10) Patent No.: US 7,330,688 B2
(45) Date of Patent: Feb. 12, 2008

(54) FIXING DEVICE AND IMAGE FORMING APPARATUS INCLUDING THE SAME

(75) Inventors: Osamu Watanabe, Yokohama (JP); Takashi Ando, Yokohama (JP)

(73) Assignee: Samsung Electronics, Co., Ltd., Suwon-Si, Gyeonggi-do (KR)

( * ) Notice: Subject to any disclaimer, the term of this patent is extended or adjusted under 35 U.S.C. 154(b) by 143 days.

(21) Appl. No.: 11/263,853

(22) Filed: Nov. 2, 2005

(65) Prior Publication Data

US 2006/0093418 A1 May 4, 2006

(30) Foreign Application Priority Data

Nov. 2, 2004 (JP) ..... 2004-319700
Oct. 13, 2005 (KR) ..... 10-2005-0096493

(51) Int. Cl.
*G03G 15/20* (2006.01)

(52) U.S. Cl. ..... 399/329; 219/216; 430/124.3

(58) Field of Classification Search ..... 399/329, 399/328; 219/216; 347/156; 430/124.1, 430/124.3

See application file for complete search history.

(56) References Cited

U.S. PATENT DOCUMENTS 5,873,020 A * 2/1999 Matsuura et al. ..... 399/329
6,795,678 B2 * 9/2004 Yura et al. ..... 399/329
2005/0111862 A1 * 5/2005 Fuma et al. ..... 399/329 X
2005/0117943 A1 * 6/2005 Nakafuji et al. ..... 399/328
2005/0129431 A1 * 6/2005 Oohara et al. ..... 399/329
2005/0191097 A1 * 9/2005 Yoshida et al. ..... 399/329
2006/0093416 A1 * 5/2006 Watanabe et al. ..... 399/329

FOREIGN PATENT DOCUMENTS

JP 2003-295651 10/2003
JP 2004-062054 2/2004
JP 2004-093753 3/2004
JP 2004-184736 A * 7/2004
JP 2004-233837 8/2004
JP 2004-295044 A * 10/2004
JP 2005-017482 A * 1/2005
JP 2005-156679 A * 6/2005
JP 2005-227612 A * 8/2005

* cited by examiner

*Primary Examiner*—Sophia S. Chen
(74) *Attorney, Agent, or Firm*—Roylance, Abrams, Berdo & Goodman, L.L.P.

(57) ABSTRACT

A fixing device and an image forming apparatus are provided that shorten warming-up time, reduce power consumption and deviation of a belt, and surely fix a toner image onto a sheet. Support members and a pressurizing member contact each other with pressure at an upstream side and a downstream side in a carrying direction of a recording medium. A first interposing portion of the belt disposed between the support members is inserted between the support members and the pressurizing member and is installed in a tensed state. A second interposing portion of the belt is installed in a non-tensed state, the pressurizing member contacts the outside of the first interposing portion to form the fixing nip portion. The support members contact the pressurizing member with different pressures at the upstream side and the downstream side in the carrying direction of the recording medium.

13 Claims, 2 Drawing Sheets

FIXING DEVICE AND IMAGE FORMING APPARATUS INCLUDING THE SAME

CROSS-REFERENCE TO RELATED PATENT APPLICATION

This application claims the benefit under 35 U.S.C. § 119(a) of Japanese Patent Application No. 2004-319700, filed on Nov. 2, 2004, in the Japanese Intellectual Property Office, and of Korean Patent Application No. 10-2005-0096493, filed on Oct. 13, 2005, in the Korean Intellectual Property Office, the entire disclosures of both of which are hereby incorporated by reference.

BACKGROUND OF THE INVENTION

1. Field of the Invention

The present invention relates to a fixing device mounted in an electrophotographic image forming apparatus, such as a laser printer or a laser facsimile, and an image forming apparatus including the same.

2. Description of the Related Art

In an electrophotographic image forming apparatus, a photosensitive drum is uniformly charged and exposed by a laser scanning unit to form an electrostatic latent image thereon according to an image signal. A charged toner is supplied to the photosensitive drum to develop the electrostatic latent image with a developer and form a toner image. The toner image is transferred onto a sheet (a recording medium). Since the toner image transferred onto the sheet is not fixed, the toner image is heated and pressed by a fixing device included in the image forming apparatus such that the toner image is fused by heat to form an image fixed on the sheet.

A conventional fixing device generally includes a cylindrical metal heat roller (an electric heating member), a press roller (a pressurizing member) contacting and applying pressure to the heat roller, and a halogen lamp (a heat source) that is mounted in the heat roller and heats the heat roller by radiant heat. In the fixing device (a two-roller type), a sheet having a toner image is inserted and carried into a fixing nip unit formed by the heat roller and the press roller. The toner image is then heated by the heat of the heat roller and fixed on the sheet by the pressurized contact between the heat roller and the press roller.

In the conventional fixing device, it takes a long time to heat the heat roller from a room temperature to a fixing temperature of 160 to 200° C. Accordingly, warming-up time from the time of applying power to the time of starting a printing operation is significantly long. Furthermore, to shorten the period from a print standby time to a print start time, the fixing device should be maintained at a high temperature. However, to maintain the fixing device at a high temperature, the fixing device should be heated by a halogen lamp, thus increasing power consumption.

Accordingly, a fixing device that can shorten the warning-up time and reduce power consumption has been suggested.

For example, an electromagnetic induction heat type fixing device includes a cylindrical or semi-circular holder. A cylindrical film is formed on the holder by laminating a conductive layer and a resistance layer. A magnetic field generating means is composed of an excitation coil and a magnetic core and mounted in the holder. A press roller presses and contacts the outer circumferential surface of the film to form a fixing nip portion. According to the electromagnetic induction heat type fixing device, an eddy current is generated by the magnetic flux generated by the magnetic field generating means. Joule's heat is generated in the conductive layer by the eddy current, and the temperature of the fixing nip portion increases by the Joule's heat. When the fixing nip portion is heated to a fixing temperature by the electromagnetic induction heat type fixing device, the temperature of the fixing nip portion can increase to the fixing temperature in a short time and the warming-up time can be shortened. Furthermore, since the film has a low heat capacity, the power consumption can be reduced. This type of fixing device is disclosed, for example, in Japanese Unexamined Patent Application Publication No. 2004-126274. However, since this fixing device needs the magnetic field generating means, the component cost increases compared with the two-roller type fixing device. Additionally, since the inner circumferential surface of the film slides on the holder, the film wears fast and thus the life span of the film is reduced. Additionally, the range of material selection is narrow.

Furthermore, a press belt pressing type fixing device has a tube type press belt instead of the press roller included in the two-roller type fixing device and presses a portion of the press belt at the inside thereof toward a heat roller to form a fixing nip portion. This press belt pressing type fixing device includes a heat roller that is heated by a heat source, such as a halogen lamp, and axially rotates. A caterpillar press belt contacts and follows the heat roller. A pressurizing member presses the surface of the press belt at the inside thereof toward the heat roller. This press belt pressing type fixing device is disclosed in Japanese Unexamined Patent Application Publication No. 2004-12682. According to this fixing apparatus, since the surface-pressed press belt contacts the heat roller with pressure, a wide fixing nip portion is formed. Thus, the warming-up time can be shortened, the power consumption can be reduced, and the component cost can be reduced compared to the electromagnetic induction heat type fixing device. However, since the inner circumferential surface of the press belt is surface-pressed and slides, the press belt is easily worn. Thus, the life span of the press belt or the pressurizing member is reduced. Additionally, the range of material selection is narrow.

Furthermore, a heat belt type fixing device employs a heat belt unit using a heat belt, instead of the heat roller included in the two-roller type fixing device, and contacts the heat roller with a press roller with pressure to form a fixing nip portion. The heat belt unit is composed by winding a caterpillar heat belt on a support roller and a cylindrical heat roller. A cylindrical press roller contacts an interposing portion of the heat belt installed between the support roller and the heat roller. A halogen lamp is mounted in the heat roller or the press roller. According to the heat belt type fixing device, since the wide fixing nip portion is formed, the warming-up time can be shortened and the power consumption can be reduced. Furthermore, since there is no sliding portion, no member is worn and various materials can be used. Additionally, the component cost can be reduced more compared to the electromagnetic induction heat type fixing device. This fixing device is disclosed in Japanese Unexamined Patent Application Publication No. 2004-205877.

However, in the conventional heat belt type fixing device, since the heat belt expands by the support roller and the heat roller and is interposed in a tensed state, if the heat roller rotates, the heat belt moves in an axial direction of the heat roller or the support roller and deviates from a predetermined trajectory due to manufacturing errors or assembling errors of each roller and fluctuation of the heat belt in a width direction.

Accordingly, a need exists for an image forming apparatus having an improved fixing device that surely fixes a toner image onto a recording medium while reducing warm-up time, power consumption and belt deviation.

SUMMARY OF THE INVENTION

The present invention provides a fixing device and an image forming apparatus that shortens warming-up time, reduces power consumption and belt deviation, and fixes a toner image onto a sheet.

According to an aspect of the present invention, a fixing device includes at least two support members, a caterpillar belt wound around the support members and movably supported in the circumferential direction of the support members, a heat source that heats the belt, and a pressurizing member that contacts the belt with pressure. A toner image is heated and fused on a recording medium by passing the recording medium on which the toner image is electrostatically formed through a fixing nip portion formed between the belt and the pressurizing member. The support members and the pressurizing member contact each other with pressure at an upstream side and a downstream side in a carrying direction of the recording medium. A first interposing portion of the belt disposed between the support members is inserted between the support members and the pressurizing member and installed in a tensed state. A second interposing portion of the belt is installed in a non-tensed state. The pressurizing member contacts the outside of the first interposing portion to form the fixing nip portion. The support members contact the pressurizing member with different pressures at the upstream side and the downstream side in the carrying direction of the recording medium.

A pressing force between the pressurizing member and the support member located at the downstream side may be greater than that of the pressurizing member and the support member located at the upstream side.

According to another aspect of the present invention, an image forming apparatus for transferring a toner image onto a recording medium to form an image has the aforementioned fixing device.

Other objects, advantages, and salient features of the invention will become apparent from the detailed description, which, taken in conjunction with the annexed drawings, discloses preferred exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
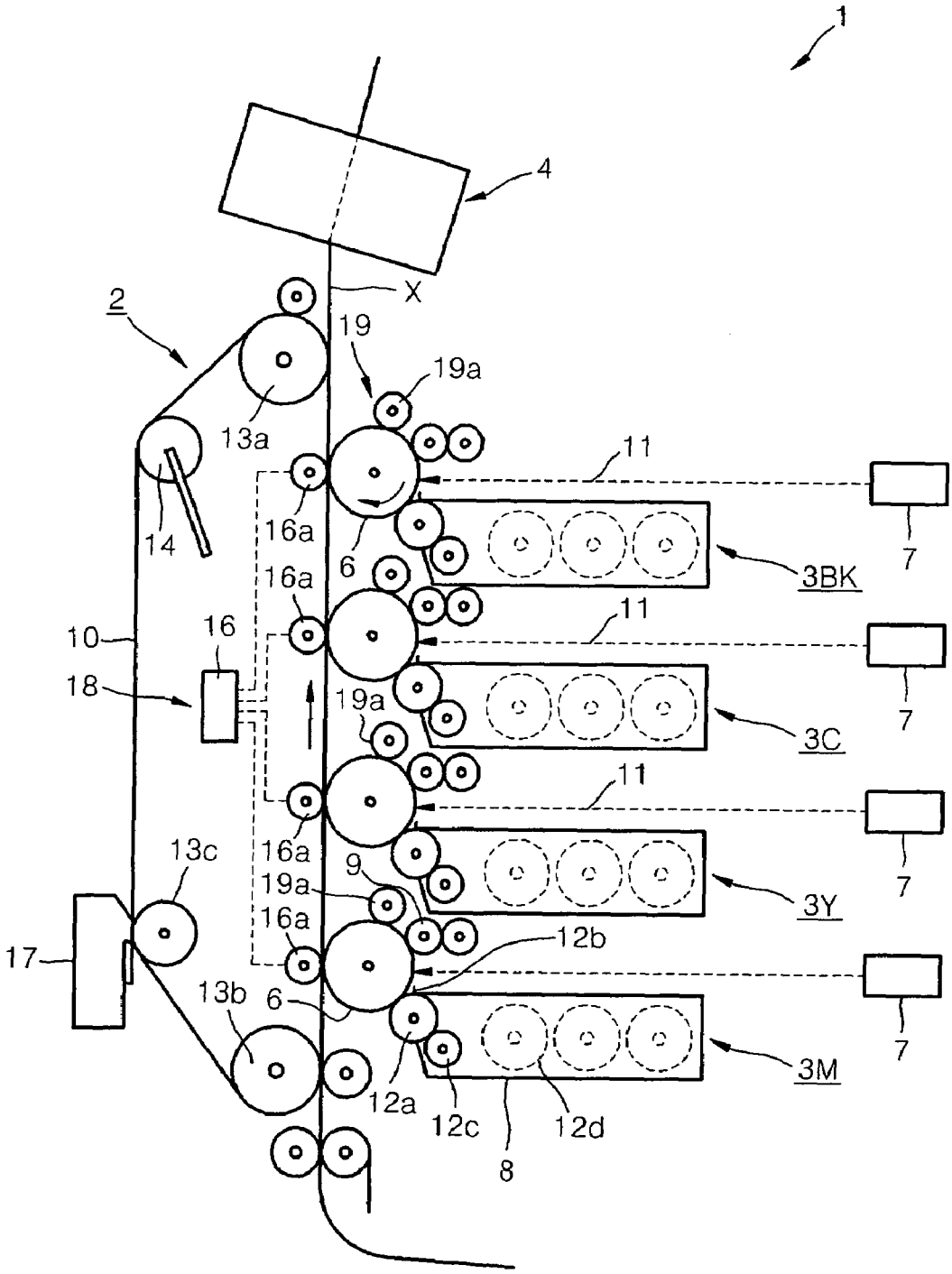
FIG. 1 a schematic diagram of an image forming apparatus including a fixing device according to an exemplary embodiment of the present invention.

Hereinafter, a fixing device and an image forming apparatus according to exemplary embodiments of the present invention are described with reference to the attached drawings. FIG. 1 illustrates a schematic construction of main portions of an image forming apparatus 1.

Referring to FIG. 1, the image forming apparatus 1 according to an exemplary embodiment includes a carrying unit 2, a plurality of image forming units (image forming means) 3M, 3Y, 3C, and 3BK that are mounted on the carrying unit 2 and electrostatically transfer a toner image onto a sheet of paper (recording medium) X, and a fixing device 4 for carrying the sheet X on which the toner image is formed and fixing (fusing) the toner image on the sheet X.

First, the image forming units 3M, 3Y, 3C, and 3BK are described.

The image forming units 3M, 3Y, 3C, and 3BK charge a photosensitive drum 6. Laser light 11 is irradiated onto the surface of the charged photosensitive drum 6 to perform an exposure operation. A latent image formed by the exposure operation is developed to form an image (a toner image). The image is transferred onto the sheet X carried by the transfer belt 10. The plurality of image forming units 3M, 3Y, 3C, and 3BK are sequentially arranged in a conveying direction of a transfer belt 10 and form toner images of magenta, yellow, cyan, and black colors at an uppermost stream side in the conveying direction of the transfer belt 10, respectively. Each of the image forming units 3M, 3Y, 3C, and 3BK includes the photosensitive drum 6, an exposure device (an exposure means) 7, a developer (a developing means) 8, a charging roller 9, and a cleaning unit 19.

The photosensitive drum 6 is an example of an image forming portion, and axially rotates in a direction indicated by an arrow shown in FIG. 1 such that a latent image is formed on the surface thereof by irradiating the laser light 11 from the exposure device 7.

The exposure unit 7 scans the laser light 11 at an exposure location of the photosensitive drum 6 in a parallel direction to the rotary shaft of the photosensitive drum 6.

The developer 8 develops the latent image to form the toner image. The developer 8 charges a powder toner of a predetermined color to a negative potential, supplies the toner to an exposure portion of the photosensitive drum 6 having a positive potential compared with a non-exposure portion in a development potential, and attaches the toner to the surface of the photosensitive drum 6. The developer 8 includes an agitator 12*d* for agitating and charging the toner, and a supplying roller 12*c* for carrying the charged toner toward a development roller 12*a*. The development roller 12*a* attaches the toner supplied from the supplying roller 12*c* to the surface of the photosensitive drum 6 by electrostatic charges according to Coulomb's force. A development blade 12*b* controls the thickness of the toner on the development roller 12*a* to a predetermined thickness.

The cleaning unit 19 includes a photosensitive drum cleaning roller 19*a* for contacting the photosensitive drum 6 and removing the toner on the surface of the photosensitive drum 6. A case (not shown) is provided in the vicinity of the cleaning roller 19*a* and collects the toner removed by the cleaning roller 19*a*.

The charging roller 9 charges the surface of the photosensitive drum 6 to a predetermined potential when forming an image. The charging roller 9 includes a conductive elastic body formed on a metal shaft and contacts the photosensitive drum 6 at a downstream electrostatic location of the photosensitive drum cleaning roller 19*a*. A nip portion in which the charging roller 9 contacts the photosensitive drum 6 in a circumferential direction with a predetermined width is formed by pressing a bearing (not shown) by an elastic pressurizing means, such as a spring. The surface of the photosensitive drum 6 is charged to a predetermined potential when a DC voltage is applied to the charging roller 9. Additionally, the charging roller 9 contacts an electrostatic roller cleaning roller that removes dirt from the surface of the charging roller 9.

Next, the carrying unit 2 is described.

The carrying unit 2 includes roller followers 13*b* and 13*c* mounted on an inner circumferential portion. A caterpillar transfer belt 10 is circulated in a direction by a tension roller 14, a driving roller 13*a*, and a transfer roller 16*a* that enables the transfer belt 10 to contact the photosensitive drum 6 at a transfer location. A belt cleaning unit 17 contacts a cleaning blade with the transfer belt 10 to detach material attached on the surface of the transfer belt 10 and has a space for collecting the attached material.

The transfer belt 10 is made of a material that absorbs the toner from the photosensitive drum 6 by a transfer voltage applied to the transfer roller 16*a* that contacts the rear surface of the transfer belt 10 when facing the photosensitive drum 6 through the sheet X, for example, a dielectric sheet. Furthermore, the transfer belt 10 has a light reflecting characteristic.

The transfer roller 16*a* includes, for example, conductive or semi-conductive synthetic rubber formed on a metal rotary shaft. A high voltage power supply (not shown) is connected to the rotary shaft of the transfer roller 16*a* to control the surface potential of the roller.

A transfer unit 18 electrostatically transfers the toner image formed by the image forming units 3M, 3Y, 3C, and 3BK onto the sheet X carried by the transfer belt 10. The transfer unit 18 is composed of the transfer roller 16*a* and a control unit 16 controlling the surface potential of the roller.

Next, the fixing device 4 is described.

Figure 2:
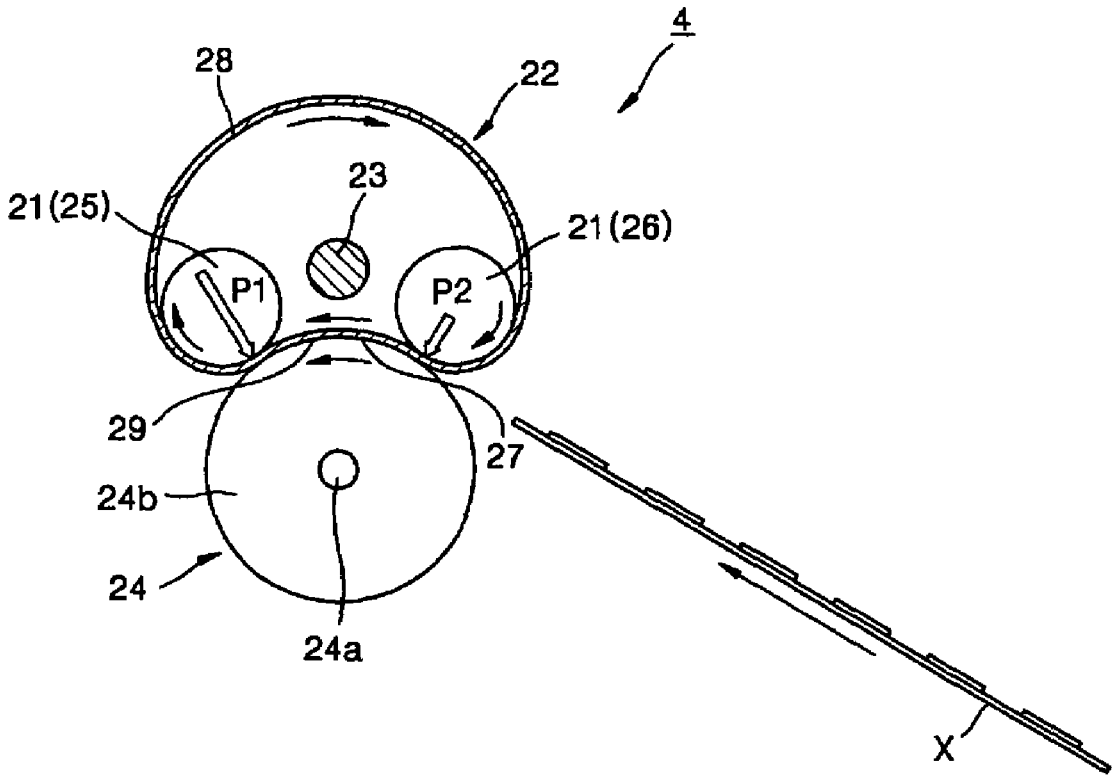
FIG. 2 is a schematic diagram of the fixing device according to an exemplary embodiment of the present invention.

FIG. 2 is a schematic diagram illustrating a construction of the fixing device 4. As shown in FIG. 2, the fixing device 4 includes a plurality of support members 21 (two being shown in FIG. 2), and a fixing belt 22 wound around the two support members and movably supported in its circumferential direction. Preferably, the fixing belt 22 is a caterpillar belt. A heat source 23 is provided in the fixing belt 22 together with the support members 21 and heats an inside of the fixing belt 22. A pressurizing member 24 contacts the support members 21 and the fixing belt 22 placed between the support members 21 with pressure.

The two support members 21 are cylindrical members that rotate in predetermined directions and contact the pressurizing member 24 mounted in the fixing belt 22 at an upstream side (right side of FIG. 2) and a downstream side (left side of FIG. 2) in the carrying direction of the sheet X (rotational direction of the pressurizing member 24) through the fixing belt 22. At this time, the pressing force P1 of the support member 21 placed at the downstream side (downstream support member) is greater than the pressing force P2 of the support member 21 placed at the upstream side (upstream support member). The downstream support member 21 is preferably a driving roller 25 that is axially rotated by a driving mechanism (not shown). The upstream support member 21 is a guide roller 26 that has a rotation resistance and presses against the circumferential movement of the fixing belt 22.

The fixing belt 22 is a thin member that has a length longer than the width of the sheet X and a cylindrical shape when it does not receive an external force. Furthermore, the fixing belt 22 is formed by laminating an elastic layer made of neoprene, such as silicon rubber, having a thickness of several hundreds of microns on the circumferential surface of a base layer composed of a metal or a heat-resistance resin film and having a thickness of several tens of microns to 150 microns, and laminating on the elastic layer a toner release layer composed of a fluorocarbon resin or a variant of fluorocarbon resin (such as polytetrafluoroethylene) having excellent heat resistance and a thickness of several tens of microns.

The fixing belt 22 is inserted and supported between the driving roller 25 and the pressurizing member 24 and between the guide roller 26 and the press roller 24 by contacting the driving roller 25 and the guide roller 26 with the pressurizing member 24 with pressure. Accordingly, the inner surface of the fixing belt 22 contacts the driving roller 25 and the guide roller 26 with pressure and moves in its circumferential direction by the rotation of the driving roller 25.

In this construction, a first interposing portion 27 of the fixing belt 22 placed between the driving roller 25 and the guide roller 26 is installed by inserting both ends thereof between the driving roller 25 and the pressurizing member 24 and between the guide roller 26 and the pressing roller 24 and applying a tension force thereto, and a second interposing portion 28 is installed in a non-tensed state.

The heat source 23 may be, for example, a halogen lamp, a main body of which is disposed in the fixing belt 22 to heat the fixing belt 22. The heat source 23 is installed such that the main body is placed in the vicinity of the fixing nip portion 29 formed by contacting the outside of the first interposing portion 27 with the pressurizing member 24.

The pressurizing member 24 is a cylindrical member, which axially rotates in a predetermined direction, and has a metal core 24*a* and an elastic layer 24*b* that is made of silicon rubber and wound around the metal core 24*a*. The pressurizing member 24 contacts the first interposing portion 27, both ends of which are inserted in the driving roller 25 and the guide roller 26, and the outside of the first interposing portion 27 and the pressurizing member 24 form the fixing nip portion 29. A pressing force in a normal direction is applied to the fixing nip portion 29 by the tension force applied to the first interposing portion 27. Since the first interposing portion 27 is inserted such that the pressing force P1 of the driving roller 25 is greater than the pressing force P2 of the guide roller 26, the pressing force between the pressurizing member 24 and the first interposing portion 27 causes a pressure gradient that increases from the guide roller 26 to the driving roller 25. The toner image formed on the sheet X passing through the fixing nip portion 29 is gradually pressed with a larger pressing force as the sheet X is carried toward the driving roller 25. That is, the toner image is pressed with a larger pressing force at the driving roller 25. Furthermore, the pressurizing member 24, which contacts the outer circumferential surface of the fixing belt 22 with pressure, axially rotates and is followed by the circumferential movement of the fixing belt 22.

An operation of the image forming apparatus 1 is now described. Since the operation of the image forming apparatus 1 is similar to a typical multi-color printer, a description of components for the image forming apparatus 1 is omitted and the operation of the fixing device 4 is described in detail.

First, when the image forming apparatus 1 operates, the heat source 23 performs a warming-up process by starting a heating operation. Particularly, the heating operation is performed until the temperature of the fixing device 4 reaches a predetermined fixing temperature. At this time, the driving roller 25 is axially rotated by the driving mechanism (not shown) and the fixing belt 22 moves in its circumferential direction by the rotation of the driving roller 25.

Additionally, the guide roller 26 and the pressurizing member 24 rotate about their respective shafts by the movement of the fixing belt 22. Furthermore, since the inner temperature of the image forming apparatus 1 increases by heat emitted from the fixing device 4, a fan (not shown) generates forced heat convection in the vicinity of the fixing device 4 to lower the inner temperature of the image forming apparatus 1.

Next, when the temperature of the fixing device 4 reaches the predetermined fixing temperature, the image forming units 3M, 3Y, 3C, and 3BK form an image on the sheet X carried by the transfer belt 10. That is, the laser light 11 is irradiated onto the surface of the photosensitive drum 6 charged by the charging roller 9 to form a latent image. The latent image is developed by the developer 8 to form a toner image. The toner image formed on the surface of the photosensitive drum 6 is transferred onto the sheet X carried by the transfer belt 10.

Next, the sheet X on which the toner image is formed is carried to the fixing device 4 and the toner image is fixed on the sheet X by the fixing belt 22 and the pressurizing member 24 while the sheet X is moving. That is, the fixing belt 22 moves in its circumferential direction and thus the sheet X on which the toner image is formed is inserted between the fixing belt 22 and the pressurizing member 24 and carried from a start point of the fixing nip portion 29 (the right side of the fixing nip portion 29 in FIG. 2), in which the fixing belt 22 contacts the pressurizing member 24 by the guide roller 26, to the inside of the fixing nip portion 29. The toner image formed on the sheet X is gradually fused by heat of the heated fixing belt 22 and fixed on the sheet X by the pressurizing member 24 in the fixing nip portion 29. Furthermore, the sheet X on which the toner image is fixed is carried from an end point (left side of the fixing nip portion 29 in FIG. 2) of the fixing nip portion 29, in which the fixing belt 22 contacts the pressurizing member 24, by the driving roller 25.

At this time, since the pressing force P1 of the driving roller 25 is greater than the pressing force P2 of the guide roller 26, the toner image, which is gradually fused in the fixing nip portion 29, is gradually pressed with a larger pressing force as the sheet X moves toward the driving roller 25. Since a larger pressing force is applied to the toner image at the driving roller 25, the toner image is fixed on the sheet X in a sufficiently fused state.

According to the fixing unit 4 described above, since the pressurizing member 24 presses the first interposing portion 27 of the fixing belt 22 in the tensed state which moves in its circumferential direction to form the wide fixing nip portion 29, a fixing time is long and thus sufficient fixation may be accomplished. Since the heated fixing belt 22 has low heat capacity, the warming-up time is shortened and the power consumption is reduced. Furthermore, since the upstream side and the downstream side of the fixing nip portion 29 respectively contact the support member 21 and the pressurizing member 24, the fixing nip portion 29 is not affected by fluctuation of the fixing belt 22 and the length and the pressing force thereof is surely maintained. Since the second interposing portion 28, which does not contact the pressurizing member 24, is installed in the non-tensed state, the second interposing portion 28 absorbs movement of the fixing belt 22 due to distortion of the section of the support member 21 or deformation of the fixing belt 22 and reduces movement of the fixing belt 22 in the axial direction of the support member 21. Furthermore, the fixing device 3 is inexpensive since it does not use expensive components.

Moreover, since the pressing force P1 between the downstream support member 21 and the pressurizing member 24 is greater than the pressing force P2 between the upstream support member 21 and the pressurizing member 24, the pressing force increases from the upstream side to the downstream side, thereby forming a pressure gradient in the fixing nip portion 29 so that a larger pressing force is applied to the end of the fixing nip portion 29. Accordingly, since the toner image, which is gradually fused when the sheet X is carried into the fixing nip portion 29, is fixed with a pressing force that gradually increases from the upstream side to the downstream side of the fixing nip portion 29, the toner image is surely fixed on the sheet X.

Additionally, since the warming-up time is shortened, the power consumption is reduced, the deviation of the belt is reduced, and because the fixing device 4 has inexpensive components, it is possible to provide an inexpensive and reliable image forming apparatus.

Since the two support members 21 for supporting the fixing belt 22 include the driving roller 25 and the guide roller 26, which rotate on their respective shafts, and the pressurizing member 24, which contacts the first interposing portion 27 of the fixing belt 22 with pressure, axially rotate, a sliding portion does not exist in the fixing belt 22, and thus the fixing belt 22 is not damaged by abrasion.

Although the fixing device and the image forming apparatus according to exemplary embodiments of the present invention have been described as above, the present invention is not limited to the exemplary embodiments and may be modified without departing from the scope of the present invention. For example, although in the exemplary embodiment, the pressing force P1 of the downstream support member 21 is greater than the pressing force P2 of the upstream support member 21 in the carrying direction of the sheet X, the pressing force of the upstream support member may be greater than that of the downstream support member. Furthermore, although the heat source 23 is spaced apart from the inner circumferential surface of the caterpillar fixing belt 22, the heat source may be disposed in the upstream support member such that the support member is heated by the radiant heat from the heat source and the belt is heated by the heat of the heated support member. Additionally, the heat source may be disposed at the outside of the caterpillar belt or the heat source may contact an electric heat member to directly heat the electric heat member.

Although in the exemplary embodiment, two support members 21 are provided at the upstream side and the downstream side, three support members may be provided, the upstream and downstream support members may serve as the guide roller and another support member may serve as the driving roller.

In the exemplary embodiment, the guide roller 26 (an upstream support member 21) has rotational resistance against the fixing belt 22. A tension force is applied to one interposing portion 27 by applying resistance against the circumferential movement to the fixing belt 22 and the other interposing portion 28 is in the non-tensed state, a tension force may be applied to one interposing portion and the other interposing portion may be in a non-tensed state by respectively including driving mechanisms for rotating the upstream support member and the downstream support member, setting the linear velocity of the downstream support member greater than that of the upstream support member, and setting a friction coefficient between the fixing belt 22 and the driving roller 25 greater than a friction coefficient between the fixing belt 22 and the guide roller 26.

Moreover, although in the exemplary embodiment, the multi-color image forming apparatus 1 includes the plurality of image forming units 3M, 3Y, 3C, and 3BK, the exemplary embodiments of the present invention may be employed for a monochromic image forming apparatus including only one image forming unit. Furthermore, since the exemplary embodiment of the present invention has a wide fixing nip portion and a long fusing time, the present invention is particularly suitable for a multi-color image forming apparatus for fixing a color toner image that is not fused well.

Furthermore, the recording medium may be a plate-shaped recording medium instead of the sheet X, and the shape and the material of the recording medium may be adequately changed.

According to a first aspect of the exemplary embodiments of the present invention, since a pressurizing member contacts at least two support members at an upstream side and a downstream side in a carrying direction of a recording medium with different pressing forces and contacts an interposing portion of a belt that is installed between the at least two support members, a wide fixing nip portion is formed. Thus, a fixing time is long such that sufficient image fixation is obtained. Furthermore, since the heated belt has a low heat capacity, warming-up time is shortened and power consumption is reduced. Additionally, since the upstream side and the downstream side of the fixing nip portion contact the support member and the pressurizing member, respectively, the range of the length and the pressing force thereof are surely maintained while not being affected by fluctuation of the belt. Since the different pressing forces are applied at the upstream side and the downstream side, a pressure gradient is formed in the fixing nip portion and a toner image is surely fixed to a sheet. Moreover, since an interposing portion that does not contact the pressurizing member is installed in a non-tensed state, the interposing portion in the non-tensed state absorbs the movement of the belt due to distortion due to a section of the support member or deformation of the belt and the movement of the belt in the axial direction of the support member is reduced. Additionally, since the present invention does not use expensive components, the component cost is reduced.

According to a second aspect of the exemplary embodiments of the present invention, the pressing force increases from the upstream side to the downstream side, thereby forming a pressure gradient in the fixing nip portion by setting the pressing force between the downstream support member and the pressurizing member greater than that between the upstream support member and the pressurizing member. As such, a larger pressing force is generated at the end of the fixing nip portion. Thus, since the toner image that is gradually fused when carrying the sheet is fixed with the pressing force that increases from the upstream side of the downstream side of the fixing nip portion, the toner image is surely fixed on the sheet.

According to a third aspect of the exemplary embodiments of the present invention, since the width of the fixing nip portion between the support members is large, a fixing time is long and sufficient fixation is obtained.

According to a fourth aspect of the exemplary embodiments of the present invention, since a warming-up time is shortened, power consumption is reduced, the deviation of the belt is reduced, and since a fixing device uses inexpensive components, it is possible to provide an inexpensive and reliable image forming apparatus.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fixing device, comprising:

at least two support members, each support member being a roller;

a belt wound around the at least two support members and movably supported in the circumferential direction of the at least two support members;

a heat source that heats the belt; and a pressurizing member that contacts the belt with pressure;

wherein a toner image is heated and fused on a recording medium by passing the recording medium on which the toner image is electrostatically formed through a fixing nip portion formed between the belt and the pressurizing member;

the support members and the pressurizing member contact each other with pressure at an upstream side and a downstream side in a carrying direction of the recording medium;

a first interposing portion of the belt disposed between the support members is inserted between the support members and the pressurizing member and installed in a tensed state, a second interposing portion of the belt is installed in a non-tensed state, and the pressurizing member contacts an outer surface of the first interposing portion to form the fixing nip portion; and the support members contact the pressurizing member with different pressures at the upstream side and the downstream side in the carrying direction of the recording medium.

2. The fixing device according to claim 1, wherein a first pressing force between the pressurizing member and the support member located at the downstream side is greater than a second pressing force between the pressurizing member and the support member located at the upstream side.

3. The fixing device according to claim 2, wherein the fixing nip portion is formed in the first interposing portion of the belt in the tensed state disposed between the support members.

4. The fixing device according to claim 2, wherein the downstream support member is a driving roller and the upstream support member is a guide roller.

5. The fixing device according to claim 1, wherein the fixing nip portion is formed in the first interposing portion of the belt in the tensed state disposed between the support members.

6. The fixing device according to claim 1, wherein the belt is a caterpillar belt.

7. An image forming apparatus for transferring a toner image onto a recording medium to form an image, comprising:

a fixing device housed within the image forming apparatus, the fixing device including at least two support members, each support member being a roller;

a caterpillar belt wound around the at least two support members and movably supported in the circumferential direction of the at least two support members;

a heat source that heats the belt; and a pressurizing member that contacts the belt with pressure;

wherein a toner image is heated and fused on a recording medium by passing the recording medium on which the toner image is electrostatically formed through a fixing nip portion formed between the belt and the pressurizing member;

the support members and the pressurizing member contact each other with pressure at an upstream side and a downstream side in a carrying direction of the recording medium;

a first interposing portion of the belt disposed between the support members is inserted between the support members and the pressurizing member and installed in a tensed state, a second interposing portion of the belt is installed in a non-tensed state, and the pressurizing member contacts an outer surface of the first interposing portion to form the fixing nip portion; and the support members contact the pressurizing member with different pressures at the upstream side and the downstream side in the carrying direction of the recording medium.

8. The image forming apparatus for transferring a toner image onto a recording medium to form an image according to claim 7, wherein a first pressing force between the pressurizing member and the support member located at the downstream side is greater than a second pressing force between the pressurizing member and the support member located at the upstream side.

9. The image forming apparatus for transferring a toner image onto a recording medium to form an image according to claim 8, wherein the fixing nip portion is formed in the first interposing portion of the belt in the tensed state disposed between the support members.

10. The image forming apparatus for transferring a toner image onto a recording medium to form an image according to claim 8, wherein the downstream support member is a driving roller and the upstream support member is a guide roller.

11. A method of transferring a toner image onto a recording medium to form an image, comprising the steps of pressurizing a caterpillar belt wound around at least two support members of a fixing device with a pressurizing member, the belt being movable in the circumferential direction of the at least two support members and the two support members being rollers;

heating the belt;

forming a fixing nip portion between the belt and the pressurizing member with the at least two support members such that a pressure gradient is formed between the at least two support members; and passing a recording medium on which a toner image is formed through the fixing nip portion to heat and fuse the toner image on the recording medium.

12. A method of transferring a toner image onto a recording medium to form an image according to claim 11, further comprising applying a first pressure force to the pressurizing member with a downstream support member; and applying a second pressure force to the pressurizing member with an upstream support member.

13. A method of transferring a toner image onto a recording medium to form an image according to claim 12, wherein the first pressure force is larger than the second pressure force.

* * * * *